US011284212B2

(12) United States Patent
Seguin et al.

(10) Patent No.: US 11,284,212 B2
(45) Date of Patent: Mar. 22, 2022

(54) DUAL PANEL AUDIO ACTUATORS AND MOBILE DEVICES INCLUDING THE SAME

(71) Applicant: Google LLC, Mountain View, CA (US)

(72) Inventors: Chad Georges Seguin, Campbell, CA (US); James East, San Jose, CA (US); Andrew Phillis, Campbell, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 16/964,279

(22) PCT Filed: Jul. 24, 2019

(86) PCT No.: PCT/GB2019/052067
§ 371 (c)(1),
(2) Date: Jul. 23, 2020

(87) PCT Pub. No.: WO2021/014112
PCT Pub. Date: Jan. 28, 2021

(65) Prior Publication Data
US 2021/0329398 A1 Oct. 21, 2021

(51) Int. Cl.
*H04S 7/00* (2006.01)
*H04R 1/32* (2006.01)

(52) U.S. Cl.
CPC ..... *H04S 7/303* (2013.01); *H04R 1/323* (2013.01); *H04R 2499/11* (2013.01)

(58) Field of Classification Search
CPC ..... H04S 7/303; H04R 1/323; H04R 2499/11; H04R 2499/15
USPC ..... 381/124, 150, 163, 303, 345, 388
See application file for complete search history.

(56) References Cited

U.S. PATENT DOCUMENTS 8,391,540 B2 3/2013 Berriman et al.
2003/0052613 A1* 3/2003 Kolpasky ..... B60R 11/0223 315/77

(Continued)

FOREIGN PATENT DOCUMENTS

CA 2273799 * 1/2011
CN 105681968 6/2016

(Continued)

OTHER PUBLICATIONS

KR Office Action in Korean Appln. No. 10-2020-7021575, dated Apr. 1, 2021, 13 pages (with English translation).

(Continued)

*Primary Examiner* — William A Jerez Lora
(74) *Attorney, Agent, or Firm* — Fish & Richardson P.C.

(57) ABSTRACT

A method for producing an audio signal from a panel audio loudspeaker in a mobile device includes receiving information about a status of the mobile device from one or more sensors of the mobile device. The method further includes driving, with a first drive signal, a first actuator coupled to a display panel of the panel audio loudspeaker at a first location and simultaneously driving, with a second drive signal, a second actuator coupled to the display panel at a second location different from the first location. The method also includes varying a relative timing of the first and second drive signals based on the information about the status of the mobile device to vary a direction of an audio signal and/or a source location of the audio signal on the display panel.

20 Claims, 4 Drawing Sheets

(56) References Cited

U.S. PATENT DOCUMENTS

| | | | | |
|---|---|---|---|---|
| 2009/0290732 | A1* | 11/2009 | Berriman | H04R 5/02 381/182 |
| 2011/0096941 | A1 | 4/2011 | Marzetta et al. | |
| 2014/0241558 | A1 | 8/2014 | Yliaho et al. | |
| 2015/0010173 | A1* | 1/2015 | Bernal Castillo | H04R 1/24 381/162 |
| 2017/0318387 | A1 | 11/2017 | Ray et al. | |
| 2018/0249248 | A1* | 8/2018 | Harris | H04R 29/002 |
| 2019/0182603 | A1 | 6/2019 | Xiang | |

FOREIGN PATENT DOCUMENTS

| | | |
|---|---|---|
| CN | 107018476 | 8/2017 |
| CN | 109189362 | 1/2019 |
| EP | 2273799 | 1/2011 |
| EP | 3264167 | 1/2018 |
| JP | 2013055571 | 3/2013 |

OTHER PUBLICATIONS

PCT International Search Report and Written Opinion in International Appln. No. PCT/GB2019/052067, dated Apr. 15, 2020, 14 pages.
Office Action in Japanese Appln. No. 2020-539082, dated Nov. 9, 2021, 11 pages (with English translation).
Office Action in Chinese Appln. No. 201980009584, dated Dec. 31, 2021, 22 pages (with English translation).

* cited by examiner

DUAL PANEL AUDIO ACTUATORS AND MOBILE DEVICES INCLUDING THE SAME

CROSS-REFERENCE TO RELATED APPLICATION

This application is a National Stage Application under 35 U.S.C. § 371 and claims the benefit of International Application No. PCT/GB2019/052067, filed Jul. 24, 2019. The disclosure of the foregoing application is hereby incorporated by reference in its entirety

BACKGROUND

Many conventional loudspeakers produce sound by inducing piston-like motion in a diaphragm. In contrast, panel audio loudspeakers (e.g., distributed mode loudspeakers (DMLs)) operate by exciting a distribution of vibration modes in a panel using an electro-acoustic actuator. Typically, the actuators are electromagnetic or piezoelectric actuators.

Conventional mobile devices, like mobile phones, include speakers that feature a piston actuator. A grating typically covers the actuator and sound is projected by the actuator through the grating. Often, the speaker grating is located in the bezel of the phone's display and the user naturally holds the phone with the grating close to their ear when listening to a call because that is where the speaker is loudest.

Panel audio loudspeakers may not have a visible speaker grating because the entire panel radiates sound. As a result, mobile devices that include panel audio loudspeakers do not necessarily have a natural fiducial for orienting the device when answering a call, for example. However, panel audio loudspeakers usually have a 'sweet spot' in the near acoustic field where sound quality is maximized because the modal response is not uniform across the panel.

SUMMARY

In order to make the sweet spot larger and louder, panel audio loudspeakers featuring a second actuator are disclosed. The two actuators can be placed at opposite ends of the panel, and bending waves generated by the second actuator can be adjusted in amplitude and/or phase to create a maximal deflection at an intended location or sweet spot. The sweet spot can be manipulated using timing delays between both actuators to move it, focus it, or expand it. That is, an independent drive signal can be used to drive each of the actuators and the drive signals can be time aligned such that vibrations generated by the actuators constructively interfere at a particular coordinate on the panel.

In some embodiments, the panel audio loudspeaker is incorporated into a mobile device and the sweet spot can be manipulated in coordination with the operation of the mobile device. For example, a mobile device can use a sensor (or sensors) to determine the location of a user's ear relative to the panel and use the information to maximize the sound output at a particular location on the panel. In addition, or alternatively, to varying the location of maximum sound output, the mobile devices can also use the information about the status of the mobile device to vary a direction of the audio signal output by the panel audio loudspeaker. Additionally, the area of the location maximum sound output can also be increased or decreased depending on the information about the status of the mobile device. In some embodiments, the timing of signals to the actuators can be altered in order to create a minimal response at certain locations. This could be done in an effort to improve privacy, so less sound is emitted from areas of the panel not directly touching the user's ear.

The mobile device can also use a sensor or sensors to affect the mode of audio output by the mobile device. For example, a mode of audio output can include a receiver (or near-field) mode and a speaker (or far field) mode. If the sensors determine that the user's ear is within a threshold distance of the panel, then the mobile device may output audio in the near-field mode, and optimize sound output at a particular location in space. If instead the sensors determine that the mobile device is placed on a surface e.g., a table, and presumably therefore the user's ear is not within the threshold distance of the panel, then the mobile device may output audio in the far field mode, e.g., using both actuators to provide maximum sound output over then entire panel.

Panels with more than two actuators are also contemplated.

In general, in a first aspect, a method for producing an audio signal from a panel audio loudspeaker in a mobile device includes receiving information about a status of the mobile device from one or more sensors of the mobile device. The method further includes driving, with a first drive signal, a first actuator coupled to a display panel of the panel audio loudspeaker at a first location and simultaneously driving, with a second drive signal, a second actuator coupled to the display panel at a second location different from the first location. The method also includes varying a relative timing of the first and second drive signals based on the information about the status of the mobile device to vary a direction of an audio signal and/or a source location of the audio signal on the display panel.

Implementations of the method can include one or more of the following features. In some implementations, the information about the status of the mobile device includes information about a relative location of a user's ear to the mobile device and the relative timing of the drive signals is varied to vary a direction and/or location of a near field audio signal. The panel audio loudspeaker can provide the near field audio signal in a telephony mode of the mobile device. In some implementations, the method further includes varying a relative amplitude of the first and second drive signals based on the information about the status of the mobile device.

The one or more sensors can be one or more accelerometers, one or more gyroscopes, one or more magnetometers, one or more GPS sensors, one or more proximity sensors, one or more touch sensors, one or more microphones, one or more radars, or one or more image sensors.

In some implementations, the method further includes simultaneously driving the first and second actuators to provide a far field audio signal from the panel audio loudspeaker. The far field audio signal can be produced in a non-telephony mode of the mobile device.

In another aspect, the subject matter includes a mobile device or a wearable device including a display panel and a pair of actuators, each coupled to the display panel at different locations, and each actuator being configured to couple vibrations into the display panel to produce an audio signal. The mobile device or wearable device also includes one or more sensors each configured to sense information about the mobile device or wearable device's environment or use. The mobile device or wearable device further includes an electronic control module electrically coupled to the actuators and the one or more sensors and programed to determine information about the mobile device or wearable device's status based on corresponding signals from the one or more sensors. The electronic control module simultaneously supplies a corresponding drive signal to each of the actuators. The electronic control module is programmed to vary a relative timing of the drive signals to the actuators to vary the modal distribution and direction of an audio signal and/or a source location of the audio signal on the display panel depending on the information about the status of the mobile device or wearable device.

In some implementations, the information about the status of the mobile device or wearable device includes information about a relative location of a user's ear to the mobile device or wearable device and the electronic control module is programmed to vary the relative timing of the drive signals to vary a direction and/or location of a near field audio signal to direct the audio signal towards the user's ear.

In some implementations, the mobile device or wearable device has a top edge and a bottom edge opposite the top edge, and one of the actuators is coupled to the display panel closer to the top edge that the bottom edge. In other implementations, the other of the actuators is coupled to the display panel closer to the bottom edge than the top edge.

The mobile device or wearable device can further include one or more additional actuators coupled to the display panel at different locations from the pair of actuators. The electronic control module can be electrically coupled to the one or more additional actuators and programmed to supply a corresponding drive signal to the one or more additional actuators.

The mobile device can be a mobile phone or a tablet computer. The wearable device can be a smart watch or a head-mounted display. The one or more sensors of the mobile device or wearable device can be one or more accelerometers, one or more gyroscopes, one or more magnetometers, one or more GPS sensors, one or more proximity sensors, one or more touch sensors, one or more microphones, and one or more image sensors. The actuators of the mobile device or wearable device can be electromagnetic actuators, piezoelectric actuators, or a combination of electromagnetic actuators and piezoelectric actuators.

Among other advantages, embodiments feature panel audio loudspeakers offering improved control in the location and direction of its audio output. The audio output can be manipulated according to the use of a device (e.g., a mobile phone) that incorporates the loudspeaker.

Other advantages will be evident from the description, drawings, and claims.

BRIEF DESCRIPTION OF THE DRAWINGS

Like reference symbols in the various drawings indicate like elements.

DETAILED DESCRIPTION

Figure 1:
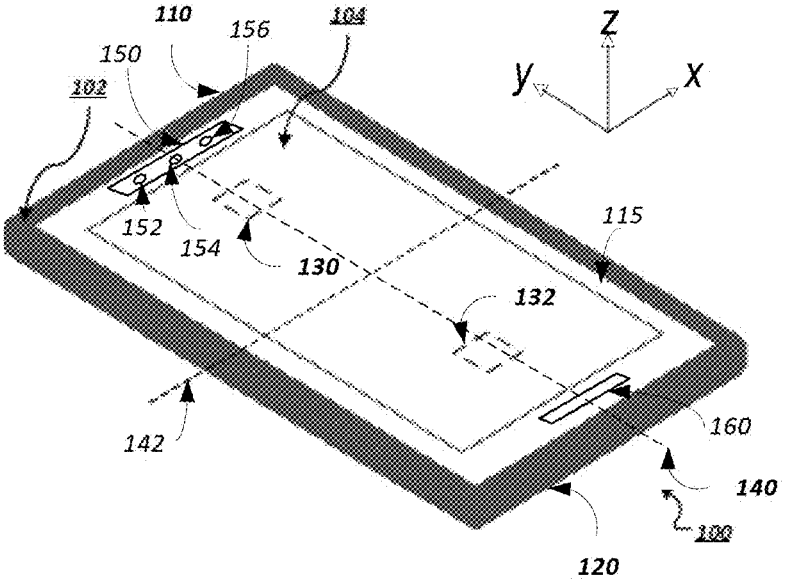
FIG. 1 is a perspective view of an embodiment of a mobile device that includes two actuators.
Figure 2:
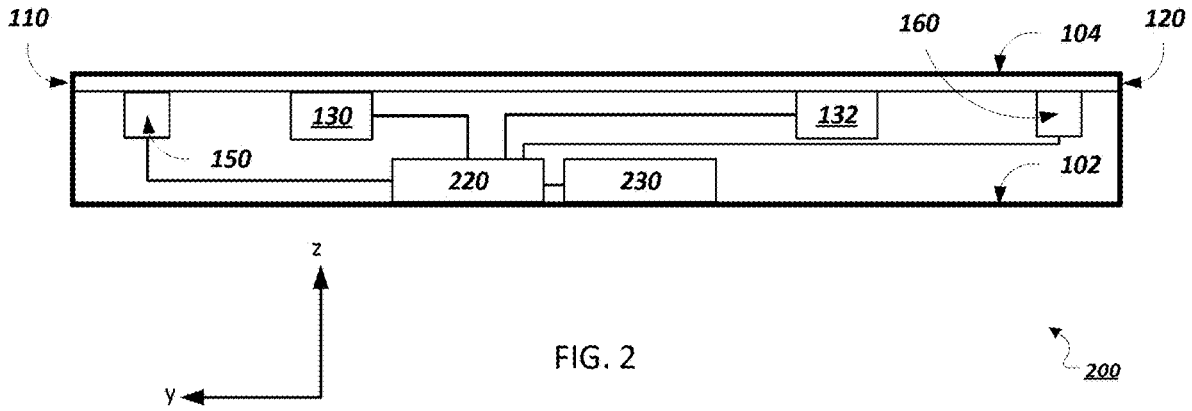
FIG. 2 is a schematic cross-sectional view of a mobile device that includes the actuators of FIG. 1.

Referring to FIG. 1 and FIG. 2, a mobile device 100 (e.g., a mobile phone) includes a device chassis 102 and a touch panel display 104 including a flat panel display (e.g., an OLED or LCD display panel) mounted in the chassis. A display bezel 115 frames an active area of the display. A sensor module 150 is located within bezel 115 at one edge 110 of the display. Sensor module 150 includes a proximity sensor 152, a camera 154, and a 3D facial recognition sensor 156. At the other edge 120 of the display, mobile device 100 includes a microphone 160 located behind bezel 115.

Mobile device 100 also includes actuators 130 and 132, which are housed behind display 104 in chassis 102 and affixed to the back side of display 104. On actuator, actuator 130, is located closer to edge 110, while actuator 132 is closer to edge 120. Together, actuators 130 and 132 and display 104 form a panel audio loudspeaker. Mobile device 100 also includes an electronic control module 220 and a battery 230, secured within device chassis 102. Signal lines connect electronic control module 220 to actuators 130 and 132, and to the sensors in sensor module 150 and microphone 160, and allows electronic control module 220 to receive signals from and deliver signals to each of these components.

Mobile device 100 produces audio output using a panel audio loudspeaker that creates sound by causing flat panel display 104 to vibrate. The vibrations are generated by actuators 130 and 132. For example, actuators 130 and 132 can be moving magnet actuators or piezoelectric actuators, e.g., distributed mode actuators (DMAs). Actuators 130 and 132 can be the same type of actuator, or can be different. Generally, the actuators are movable components arranged to provide a force to the panel in response to appropriate electrical drive signals, causing the panel to vibrate. The vibrating panel generates human-audible sound waves, e.g., in the range of 20 Hz to 20 kHz.

In addition to producing sound output, mobile device 100 can also produce haptic output using the actuators. For example, the haptic output can correspond to vibrations in the range of 180 Hz to 300 Hz.

Typically, mobile devices like device 100 have a depth (in the z-direction of the Cartesian coordinate system shown in FIGS. 1 and 2) of approximately 10 mm or less, a width (in the x-direction) of 60 mm to 80 mm (e.g., 68 mm to 72 mm), and a height (in the y-direction) of 100 mm to 160 mm (e.g., 138 mm to 144 mm).

Both actuators 130 and 132 are placed along axis 140 which bisects device 100 along its width (axis 140 runs parallel to the y-axis). The actuators are offset from axis 142, which bisects mobile device along its length (axis 142 is parallel to the x-axis), with actuator 130 being positioned closer to sensor module 150 and actuator 132 being positioned closer to microphone 160. Accordingly, the modal response of panel 104 can be varied by varying the relative amplitude, frequency, and/or phase of the signals driving each other actuators to provide different speaker modes. Moreover, varying the drive signals for the two actuators enables the panel audio loudspeaker to switch between different audio modes, depending on how the device is used. For example, the drive signals to actuators 130 and 132 can be tuned to provide a directional audio signal. The audio signal's direction can be adjusted, for instance, by varying a phase difference between the drive signals for the two actuators. In phase signals can provide a substantially uniform (i.e., spatially non-directional) audio signal.

In general, electronic control module 220 can control the drive signals of the actuators based on how mobile device 100 is used. For example, when mobile device 100 is used to make a telephone call, control module 220 can preferentially drive actuator 130, providing a near field audio signal directed to the "top" of the device (i.e., where the user is likely to place their ear). Conversely, when mobile device 100 is used to play audio content, e.g., using a music application, electronic control module 220 can drive actuators 130 and 132 to provide a substantially uniform far field audio signal, allowing the audio content to be listened to equally well regardless of where the user is with respect to the mobile device. Alternatively, or additionally, where mobile device 100 is used to view video content, electronic control module 220 can drive the actuators to provide maximum volume to a far field location substantially normal to the display, i.e., where a user is likely to be viewing the video content.

In some embodiments, electronic control module 220 drives actuators 130 and 132 in response to signals from one or more of the mobile device's sensors. For example, electronic control module 220 can drive the actuators based on information from proximity sensor 152. Where proximity sensor detects the presence of a user, e.g., as they hold the device up to their ear, the control module can switch from a loudspeaker mode (e.g., driving both actuators to provide a uniform far field audio signal) to a telephony mode (e.g., driving one or both actuators to provide a directional near field signal toward the top of the device).

Alternatively, or additionally, electronic control module 220 can adjust how it drives the actuators based on signals from an accelerometer and/or a gyroscope in the device. For example, the control module can use information from such a sensor to establish which end of the device the user is holding up to their ear and can adjust the actuator drive signals accordingly. Including two actuators positioned substantially symmetrically with respect to the midpoint of the device allows the device to generate comparable directional audio signals directed either towards the top of the device, or towards the bottom (i.e., the end with microphone 160). This allows the device to provide comparable directional audio output in a telephony mode, for example, to a user regardless of which end of the device they are holding to their ear.

In some implementations, electronic control module 220 varies the actuator drive signals based on information from camera 154 and/or 3D facial recognition sensor 156. For example, either of these sensors can detect a user, e.g., the face of a user, and estimate a distance between the mobile device and the user. If the estimated distance between the mobile device and the user is greater than or equal to a threshold distance, then the panel audio loudspeaker can increase the volume of the panel audio loudspeaker or switch the panel audio loudspeaker to a far field mode from a near field mode.

As another example, the electronic control module can use information from camera 154 and/or 3D facial recognition sensor 156 to determine a direction of a user relative to the mobile device. In response, the electronic control module can direct the audio output by the panel audio loudspeaker towards the direction of the user.

In some implementations, electronic control module 220 adjusts the actuator drive signals based on information from a touch sensor. For example, the touch sensor can detect the location of the user's ear based on where the user's ear touches the device. The electronic control module can use this information to direct the sound output towards the user's ear and/or to determine an optimal position of audio output by the device.

In some implementations, electronic control module adjusts the actuator drive signals based on information from microphone 160. The microphone can provide, to the electronic control module, information related to a noise level of the environment of the mobile device, for example. If the ambient noise level is greater than or equal to a threshold value, the electronic control module can affect the audio output by the mobile device. For example, if the ambient noise level is greater than or equal to a threshold value, the electronic control module can increase the volume of the panel audio loudspeaker or operate the panel audio loudspeaker in a far field mode.

As a further example, the electronic control module can switch the panel audio loudspeaker from a far field mode to a near field mode based on information received by the microphone. For example, the mobile device may be placed on a surface while it outputs audio in a speaker mode. If the user picks up the mobile device and begins using it as if it were in a receiver mode, the microphone can detect the user's speech and communicate this information to the electronic control module, which can change the mode of the panel audio loudspeaker from a speaker mode to a receiver mode. In addition to switching from a far field mode to a near field mode, the electronic control module can also switch the panel audio loudspeaker from a near field mode to a far field mode based on information received by the microphone.

In general, mobile devices such as device 100 can utilize one or more of a variety of different sensors to provide information about the mobile device's environment and/or mode of operation, and vary the operation of the panel audio loudspeaker accordingly. For example, mobile devices can include one or more of the following types of sensor: an accelerometer, a gyroscope, a magnetometer, a GPS sensor, a proximity sensor, a touch sensor, a microphone, a radar, or an image sensor.

Figure 3:
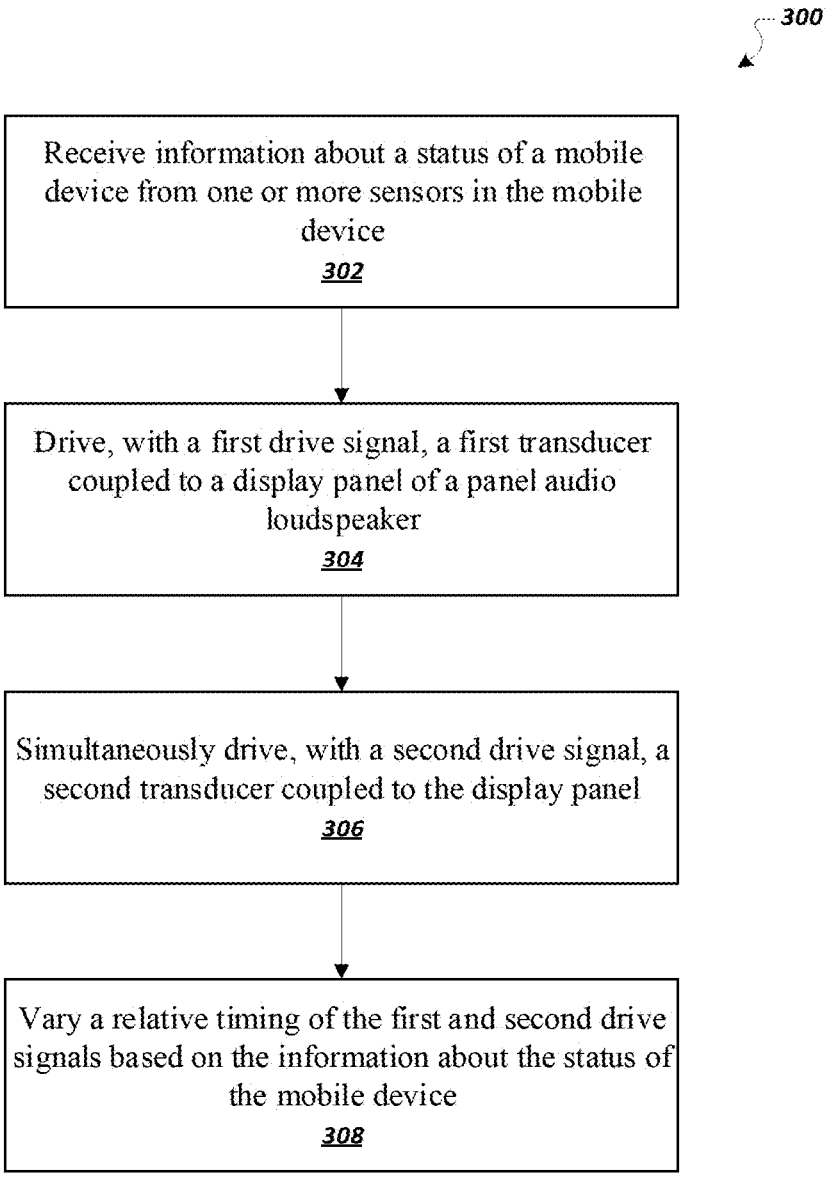
FIG. 3 is a flow diagram of an example process for varying a direction of an audio signal and/or a source location of the audio signal on a display panel.

FIG. 3 shows a flow diagram 300 of an example process for varying a direction of an audio signal and/or a source location of the audio signal on a display panel. When appropriately programmed, electronic control module 220 can perform the example process.

The electronic control module receives information about a status of a mobile device from one or more sensors of the mobile device (302).

The electronic control module drives, with a first drive signal, a first actuator coupled to a display panel of a panel audio loudspeaker at a first location (304). The first location is closer to the top edge of the mobile device than a bottom edge.

Simultaneous to stage 304, the electronic control module drives, with a second drive signal, a second actuator coupled to the display panel at a second location different from the first location (306). The second location is closer to the bottom edge than the top edge.

The electronic control module varies a relative timing of the first and second drive signals based on the information about the status of the mobile device to vary a direction of an audio signal and/or a source location of the audio signal on the display panel (308). In general, when the electronic control module drives the actuators, bending waves propagate through the panel of the mobile device as a result of the vibration of the actuators. The bending waves can constructively interfere at designated locations on the panel of the mobile device. The locations of constructive interference are locations in which the audio output by the panel audio loudspeaker is greatest. Varying the relative timing of the drive signals, e.g., phase shifting one drive signal relative to another, determines the locations of constructive interference. The direction in which the audio signal propagates is also dependent on the relative timing of the drive signals.

The locations of constructive interference, and therefore, greatest audio output, may not correspond to an optimal location for the user. For example, the location of greatest audio output is not optimal if it is located at the center of the panel when the user's ear is positioned at the top of the panel. Furthermore, the direction of the audio signal may not be optimal if the direction is not in line with the user's ear.

In general, the electronic control module varies the audio source location, e.g., the location of greatest audio output, by varying the relative timing of the drive signals. For example, the electronic control module can vary the timing so that the bending waves constructively interfere at a certain location on the panel. For example, when the drive signals are in phase with one another, the bending waves constructively interfere at a first location, while a phase shift of 180 degrees can result in the bending waves constructively interfering at a second location, different from the first location. Intermediate phase shifting values are also possible, and result in different locations of interference.

Adjusting the phase of the driving signals relative to one another allows electronic control module 220 to selectively cancel or reinforce certain vibrational modes of the panel audio loudspeaker, e.g., allowing audio signals output by the loudspeaker to be superposed on one another, to deliver a tailored response at a specific location in space.

For example, driving both actuators in phase, i.e., driving the actuators with signals that are in phase, may result in the highest far field sound pressure output by the panel audio loudspeaker. When driving both actuators in phase, the sound output is mono sound.

Driving the actuators 180 degrees out of phase may promote non-radiating vibrational modes of the panel, minimize far field sound pressure output of the mobile device, and reduce sound leakage e.g., when the panel audio loudspeaker is operating in a near field mode.

The propagation speed of a wave can depend on the frequency of the wave, e.g., high frequency waves may travel faster than low frequency waves. Electronic control module 220 can account for this difference in propagation speed by varying the phase of a first actuator driving signal relative to a second. For example, electronic control module 220 can drive a first actuator with a signal having a first phase to generate a low frequency audio signal intended to interfere with a particular audio signal at a particular location. Furthermore, electronic control module 220 can drive the first actuator with a signal having a second phase, different from the first phase, when generating a high frequency audio signal intended to interfere with the particular audio signal at the particular location.

In addition to adjusting the phase of the driving signals, electronic control module 220 can also adjust the amplitude of the signals. As audio signals propagate, they attenuate. Therefore, to achieve interference of a first audio signal output at a first actuator location and a second audio signal output at a second actuator location, electronic control module 220 may increase the amplitude of the second actuator driving signal relative to the first actuator driving signal, so that the second audio signal has an amplitude large enough to account for the attenuation of the audio signal as it propagates to the first actuator location.

In some implementations, the electronic control module can also vary the timing of the waves such that the bending waves are minimized at designated coordinates on the panel. For example, the electronic control module can vary the phase difference between two drive signals such that the bending waves produced by the actuators destructively interfere at a particular location. For example, minimizing the response of the panel at designated coordinates can improved privacy, e.g., so less sound is emitted from areas of the panel that are not within at least a threshold distance of the user's ear.

Figure 4:
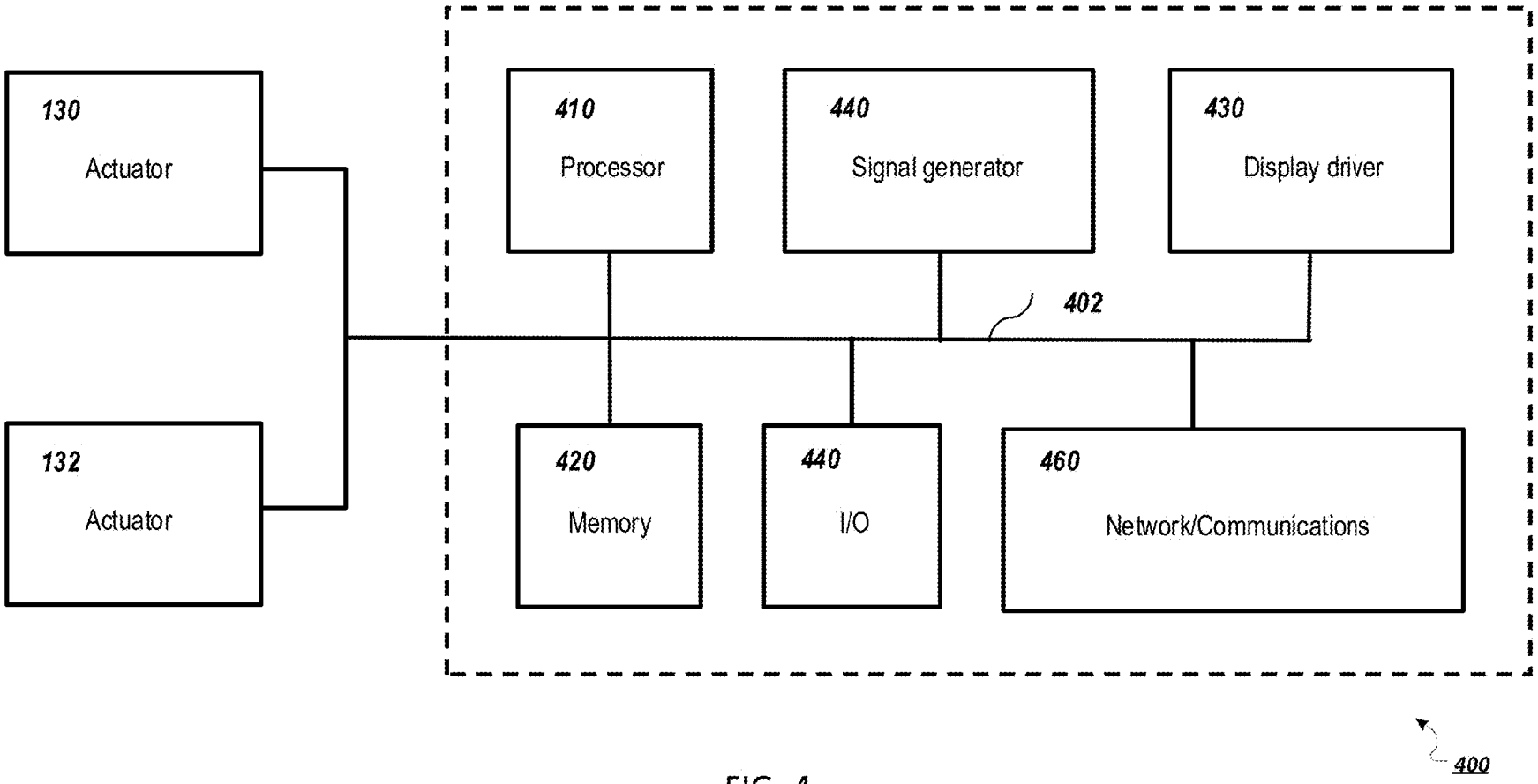
FIG. 4 is a schematic diagram of an embodiment of an electronic control module for a mobile device.

As discussed above, the actuators and sensors in mobile device 100 are controlled by an electronic control module, i.e., electronic control module 220. In general, electronic control modules are composed of one or more electronic components that receive input from one or more sensors and/or signal receivers of the mobile phone, process the input, and generate and deliver signal waveforms that cause actuators 130 and 132 to provide a suitable haptic response. Referring to FIG. 4, an exemplary electronic control module 400 of a mobile device, such as mobile device 100, includes a processor 410, memory 420, a display driver 430, a signal generator 440, an input/output (I/O) module 450, and a network/communications module 460. These components are in electrical communication with one another (e.g., via a signal bus 402) and with actuators 130 and 132.

Processor 410 may be implemented as any electronic device capable of processing, receiving, or transmitting data or instructions. For example, processor 410 can be a microprocessor, a central processing unit (CPU), an application-specific integrated circuit (ASIC), a digital signal processor (DSP), or combinations of such devices.

Memory 420 has various instructions, computer programs or other data stored thereon. The instructions or computer programs may be configured to perform one or more of the operations or functions described with respect to the mobile device. For example, the instructions may be configured to control or coordinate the operation of the device's display via display driver 430, signal generator 440, one or more components of I/O module 450, one or more communication channels accessible via network/communications module 460, one or more sensors (e.g., biometric sensors, temperature sensors, accelerometers, optical sensors, barometric sensors, moisture sensors and so on), and/or actuators 130 and 132.

Signal generator 440 is configured to produce AC waveforms of varying amplitudes, frequency, and/or pulse profiles suitable for actuators 130 and 132 and producing acoustic and/or haptic responses via the actuator. Although depicted as a separate component, in some embodiments, signal generator 440 can be part of processor 410. In some embodiments, signal generator 440 can include an amplifier, e.g., as an integral or separate component thereof.

Memory 420 can store electronic data that can be used by the mobile device. For example, memory 420 can store electrical data or content such as, for example, audio and video files, documents and applications, device settings and user preferences, timing and control signals or data for the various modules, data structures or databases, and so on. Memory 420 may also store instructions for recreating the various types of waveforms that may be used by signal generator 440 to generate signals for actuators 130 and 132. Memory 420 may be any type of memory such as, for example, random access memory, read-only memory, Flash memory, removable memory, or other types of storage elements, or combinations of such devices.

As briefly discussed above, electronic control module 400 may include various input and output components represented in FIG. 4 as I/O module 450. Although the components of I/O module 450 are represented as a single item in FIG. 4, the mobile device may include a number of different input components, including buttons, microphones, switches, and dials for accepting user input. In some embodiments, the components of I/O module 450 may include one or more touch sensor and/or force sensors. For example, the mobile device's display may include one or more touch sensors and/or one or more force sensors that enable a user to provide input to the mobile device.

Each of the components of I/O module 450 may include specialized circuitry for generating signals or data. In some cases, the components may produce or provide feedback for application-specific input that corresponds to a prompt or user interface object presented on the display.

As noted above, network/communications module 460 includes one or more communication channels. These communication channels can include one or more wireless interfaces that provide communications between processor 410 and an external device or other electronic device. In general, the communication channels may be configured to transmit and receive data and/or signals that may be interpreted by instructions executed on processor 410. In some cases, the external device is part of an external communication network that is configured to exchange data with other devices. Generally, the wireless interface may include, without limitation, radio frequency, optical, acoustic, and/or magnetic signals and may be configured to operate over a wireless interface or protocol. Example wireless interfaces include radio frequency cellular interfaces, fiber optic interfaces, acoustic interfaces, Bluetooth interfaces, Near Field Communication interfaces, infrared interfaces, USB interfaces, Wi-Fi interfaces, TCP/IP interfaces, network communications interfaces, or any conventional communication interfaces.

In some implementations, one or more of the communication channels of network/communications module 460 may include a wireless communication channel between the mobile device and another device, such as another mobile phone, tablet, computer, or the like. In some cases, output, audio output, haptic output or visual display elements may be transmitted directly to the other device for output. For example, an audible alert or visual warning may be transmitted from the mobile device 100 to a mobile phone for output on that device and vice versa. Similarly, the network/communications module 460 may be configured to receive input provided on another device to control the mobile device. For example, an audible alert, visual notification, or haptic alert (or instructions therefore) may be transmitted from the external device to the mobile device for presentation.

In general, a number of embodiments have been disclosed. However, other embodiments are possible. For example, while actuators 130 and 132 in device 100 are positioned symmetrically with respect to the width of the device, but offset with respect to the length-wise midpoint of the device, other arrangements are possible. Generally, the actuators are positioned at locations where they provide desired acoustic properties and/or where there is sufficient room to accommodate them within the device. As to the achieving a desired acoustic response, their placement can be determining empirically and/or by simulation of the acoustic response of the system.

Furthermore, while FIG. 2 shows mobile device 200 that includes two actuators 130 and 132, in some implementations, additional actuators can be used (e.g., three actuators, four actuators, five actuators or more). Generally, the actuators can be positioned on the panel in locations where they can be accommodated within the device chassis and/or where they provide a desired acoustic response.

Also, while the embodiments above relate to a mobile handset, other form factors are possible. For example, the disclosed principles can be applied to other devices using panel audio loudspeakers, such as tablet computers or wearable devices, for example.

Other embodiments are in the following claims.

What is claimed is:

1. A method for producing an audio signal from a panel audio loudspeaker in a mobile device, the method comprising:

receiving information about a status of the mobile device from one or more sensors of the mobile device, wherein the information about the status of the mobile device comprises information about a relative location of a user's ear to the mobile device;

driving, with a first drive signal, a first actuator coupled to a display panel of the panel audio loudspeaker at a first location;

simultaneously driving, with a second drive signal, a second actuator coupled to the display panel at a second location different from the first location; and varying a relative timing of the first and second drive signals based on the information about the status of the mobile device to vary a direction of an audio signal and/or a source location of the audio signal on the display panel.

2. The method of claim 1, wherein the relative timing of the drive signals is varied to vary a direction and/or location of a near field audio signal.

3. The method of claim 2, wherein the panel audio loudspeaker provides the near field audio signal in a telephony mode of the mobile device.

4. The method of claim 1, further comprising varying a relative amplitude of the first and second drive signals based on the information about the status of the mobile device.

5. The method of claim 1, wherein the one or more sensors are selected from the group consisting of an accelerometer, a gyroscope, a magnetometer, a GPS sensor, a proximity sensor, a touch sensor, a microphone, a radar, and an image sensor.

6. The method of claim 1, further comprising simultaneously driving the first and second actuators to provide a far field audio signal from the panel audio loudspeaker.

7. The method of claim 6, wherein the far field audio signal is produced in a non-telephony mode of the mobile device.

8. A mobile device, comprising:

a display panel;

a pair of actuators, each coupled to the display panel at different locations, each actuator being configured to couple vibrations into the display panel to produce an audio signal;

one or more sensors each configured to sense information about the mobile device's environment or use; and an electronic control module electrically coupled to the actuators and the one or more sensors and programed to determine information about the status of the mobile device based on corresponding signals from the one or more sensors and simultaneously supply a corresponding drive signal to each of the actuators, wherein the information about the status of the mobile device comprises information about a relative location of a user's ear to the mobile device, wherein the electronic control module is programmed to vary a relative timing of the drive signals to the actuators to vary the modal distribution and direction of an audio signal and/or a source location of the audio signal on the display panel depending on the information about the status of the mobile device.

9. The mobile device of claim 8, wherein the electronic control module is programmed to vary the relative timing of the drive signals to vary a direction and/or location of a near field audio signal to direct the audio signal towards the user's ear.

10. The mobile device of claim 8, wherein the one or more sensors are selected from the group consisting of an accelerometer, a gyroscope, a magnetometer, a GPS sensor, a proximity sensor, a touch sensor, a microphone, and an image sensor.

11. The mobile device of claim 8, wherein the mobile device has a top edge and a bottom edge opposite the top edge, and one of the actuators is coupled to the display panel closer to the top edge that the bottom edge.

12. The mobile device of claim 11, wherein the other of the actuators is coupled to the display panel closer to the bottom edge than the top edge.

13. The mobile device of claim 8, further comprising one or more additional actuators coupled to the display panel at different locations from the pair of actuators, the electronic control module being electrically coupled to the one or more additional actuators and programmed to supply a corresponding drive signal to the one or more additional actuators.

14. The mobile device of claim 8, wherein the actuators are selected from the group consisting of electromagnetic actuators and piezoelectric actuators.

15. The mobile device of claim 8, wherein the mobile device is a mobile phone or a tablet computer.

16. A wearable device comprising:

a display panel;

a pair of actuators, each coupled to the display panel at different locations, each actuator being configured to couple vibrations into the display panel to produce an audio signal;

one or more sensors each configured to sense information about the wearable device's environment or use; and an electronic control module electrically coupled to the actuators and the one or more sensors and programed to determine information about the status of the wearable device based on corresponding signals from the one or more sensors and simultaneously supply a corresponding drive signal to each of the actuators, wherein the information about the status of the wearable device comprises information about a relative location of a user's ear to the wearable device, wherein the electronic control module is programmed to vary a relative timing of the drive signals to the actuators to vary the modal distribution and direction of an audio signal and/or a source location of the audio signal on the display panel depending on the information about the status of the wearable device.

17. The wearable device of claim 16, wherein the wearable device is a smart watch or a head-mounted display.

18. The method of claim 1, wherein the information about the relative location of the user's ear to the mobile device indicates whether the user's ear is within a threshold distance to the display panel.

19. The mobile device of claim 8, wherein the information about the relative location of the user's ear to the mobile device indicates whether the user's ear is within a threshold distance to the display panel.

20. The wearable device of claim 16, wherein the information about the relative location of the user's ear to the wearable device indicates whether the user's ear is within a threshold distance to the display panel.

* * * * *